US006179259B1

(12) United States Patent
Schioldager

(10) Patent No.: US 6,179,259 B1
(45) Date of Patent: Jan. 30, 2001

(54) RAZOR HOLDER SYSTEM

(76) Inventor: Richard D. Schioldager, 2836 Fairfield St., San Diego, CA (US) 92110

( * ) Notice: Under 35 U.S.C. 154(b), the term of this patent shall be extended for 0 days.

(21) Appl. No.: 09/264,528

(22) Filed: Mar. 8, 1999

(51) Int. Cl.[7] ..... A47B 96/06

(52) U.S. Cl. ..... 248/213.2; 206/228; 220/735; 248/309.1; 248/314; 248/682

(58) Field of Search ..... 248/360, 213.2, 248/213.1, 320, 322, 314, 315, 905, 309.1, 302, 303, 304, 305, 306, 690, 231.71, 231.81; 206/228, 229, 354; 211/13.1, 70.3; 30/41, 90

(56) References Cited

U.S. PATENT DOCUMENTS

| | | | | |
|---|---|---|---|---|
| D. 252,133 | * | 6/1979 | Fitzgerald et al. | D9/261 |
| D. 315,306 | * | 3/1991 | Reister | D9/434 |
| 2,864,510 | * | 12/1958 | Sture | 211/70.3 |
| 2,970,720 | * | 2/1961 | Dooley, Jr. | 220/735 |
| 3,272,323 | * | 9/1966 | Ewry | 206/229 |
| 3,486,630 | * | 12/1969 | Ellman | 211/13.1 |
| 4,141,445 | * | 2/1979 | Korich | 206/228 |
| 4,232,785 | * | 11/1980 | Lucas | 206/228 |
| 4,656,738 | * | 4/1987 | Corah | 30/41 |
| 4,695,029 | * | 9/1987 | Fox et al. | 248/360 |
| 5,755,415 | * | 5/1998 | Sorg | 248/213.2 |
| 5,988,575 | * | 11/1999 | Lesko | 248/213.2 |

* cited by examiner

*Primary Examiner*—Ramon O. Ramirez
*Assistant Examiner*—Tan Le
(74) *Attorney, Agent, or Firm*—Stetina Brunda Garred & Brucker

(57) ABSTRACT

Devices for detachably securing razors with cans or containers of shaving cream. According to the first embodiment, the invention comprises a holder member mounted or formed upon the cap of a conventional can of shaving cream. The holder member defines an aperture or axial pathway for receiving the handle portion of a conventional razor, as well as a support surface for receiving the razor head of such razor. In a second preferred embodiment, the device comprises first and second members hingingly attached to one another and mountable upon the dispenser mechanism of a can of shaving cream. The second annular member is selectively transitionable between a first non-operative configuration wherein the same is radially nested within the first annular member, and a second operative configuration wherein the same extends outwardly from the first annular member and defines an aperture through which the handle portion of a conventional razor may be received and a support surface upon which the head of a razor may rest.

7 Claims, 2 Drawing Sheets

RAZOR HOLDER SYSTEM

BACKGROUND OF THE INVENTION

As is well-known throughout the world, razors and shaving creams are complementary goods that must necessarily be utilized with one another to produce optimal shaving results. As consumer items, however, such products are disassociated from one another and sold separately. As a result, there is currently lacking any type of uniform or convenient way by which shaving cream containers and razors can be collectively grouped with one another so that they may be easily and readily accessed. Indeed, the lack of any uniform method by which razors can be effectively coupled to shaving cream cans often results in the razor falling or otherwise being dropped when the user attempts to reach for the same as can occur for those individuals attempting to shave in the shower.

While razor holding devices are known, and in particular holding devices that can be detachably mounted to a wall such as by means of a suction cup, such devices are not adapted to place the razor held thereby in close proximity to a given can of shaving cream, let alone attach the same thereto. As a consequence, the two items, and in particular the razor, become inconvenient to store and repeatedly utilize.

As an alternative to razor holding devices of the aforementioned variety, it is known in the art to simply place the razor in a cup by a sink or wash basin where a given individual typically shaves. Such practice, however, has the drawback of not placing the razor in close proximity with a can of shaving cream as would be optimal insofar as such items are utilized in conjunction with one another as discussed above. Moreover, such practice often results in the accumulation of water within the cup. Due to the fact that the cup does not drain, such reservoir can potentially become a breeding ground for harmful bacteria.

As such, there is a substantial need in the art for razor holding apparatus for conveniently unifying a conventional shaving cream can with a razor such that the latter can be easily accessed and stored when not in use. There is a further need in the art for systems and devices for conveniently and effectively holding and storing a razor in combination with a conventional can of shaving cream that can be utilized to hold virtually all types of razors currently in use. There is still further need in the art for a razor holding apparatus that is of simple construction, inexpensive to manufacture, can be formed upon or otherwise utilized with virtually any type of can or container of shaving cream or any other type of similar product.

BRIEF SUMMARY OF THE INVENTION

The present invention specifically addresses and alleviates the above-identified deficiencies in the art. In this regard, the present invention is directed to a razor holder system for receiving and detachably securing a conventional razor with a conventional can of shaving cream. According to a first embodiment, the invention comprises a C- or U-shaped holder member molded or otherwise affixed to a cap of a conventional can of shaving cream. The member is sized and adapted to receive and accommodate the handle portion of a conventional razor such that in use, the head of the razor abuts with and rests upon the holder member as the handle portion of the razor extends axially downward therethrough. Due to the gravitational pull acting upon the razor, the same is thus caused to remain securely in position until such time as the razor, and in particular the handle portion thereof, is vertically extended axially through the aperture defined by the holder member. In an alternative configuration, the holder member may be comprised of first and second inwardly-biased barb members formed in parallel relation to one another. The barbed members cooperate to form a clip into which the handle portion of a conventional razor may be detachably secured into position. The holder members may be formed anywhere about the cap of the can of shaving cream, and may be further formed upon the can itself.

In a second preferred embodiment, the system comprises the combination of first and second concentrically disposed annular members, hingingly engaged to one another, that are collectively mountable upon the dispenser of a conventional can of shaving cream. According to such embodiment, the first annular member is formed as an outer member mountable upon the shaving cream can dispenser with the second annular member being capable of nesting radially therewithin. A fastener member is optionally provided to enable the second annular member to detachably fasten to the first annular member to assume a first secure, non-operative configuration. Due to the concentric apertures formed upon the first and second annular members, the dispenser button of the can of shaving cream can be easily accessed so that the contents of the can of shaving cream can be readily and easily accessed as per conventional cans.

In use, the second annular member may be detached from its position nested within the first annular member and rotated about its hinge connection therewith to assume a second operative configuration. When in the operative configuration, the second annular member extends outwardly from the can and defines an aperture through which the handle portion of a conventional razor may extend. The head of the razor, as per the first embodiment, rests upon the second annular member.

It is therefore an object of the present invention to provide a razor holding system and apparatus for securing a razor to a conventional can of shaving cream that enables the two respective items to be conveniently and collectively stored with one another.

Another object of the present invention is to provide a razor holding system and apparatus for securing a razor to a conventional can of shaving cream that is of simple construction, inexpensive to manufacture, and easy to use.

Still further objects of the present invention are to provide a razor holding system and apparatus for securing a razor to a conventional can of shaving cream that can be utilized with virtually all types of conventional cans/containers of shaving cream, as well as virtually all types of commercially available razors, and may be further formed to be either disposable, for convenience, or reusable.

BRIEF DESCRIPTION OF THE SEVERAL VIEWS OF THE DRAWING

These, as well as other features of the present invention will become more apparent upon reference to the drawings wherein.

DETAILED DESCRIPTION OF THE INVENTION

Figure 1:
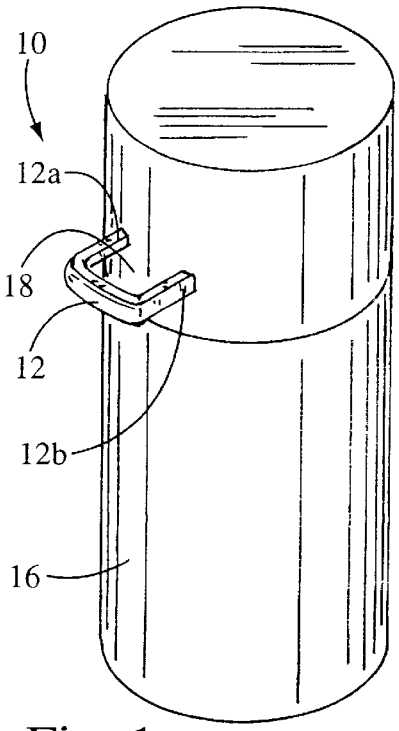
FIG. 1 is a perspective view of a conventional can of shaving cream with cap mounted thereon, the latter having a razor holder apparatus formed thereon constructed in accordance to a first preferred embodiment of the present invention.

The detailed description as set forth below in connection with the appended drawings is intended as a description of the presently preferred embodiments of the invention, and is not intended to represent the only form in which the present invention may be constructed or utilized. The description sets forth the functions and sequences of steps for constructing and operating the invention in connection with the illustrated embodiments. It is understood, however, that the same or equivalent functions and sequences may be accomplished by different embodiments and that they are also intended to be encompassed within the scope of this invention.

Referring now to the drawings, initially to FIGS. 1–4, there is shown a first embodiment of a razor holder device 10 constructed in accordance to a preferred embodiment of the present invention. The device 10 is specifically designed and configured to be attached to or formed upon the cap 14 of a conventional can of shaving cream 16. The cap 14 and can of shaving cream 16, as will be recognized by those skilled in the art, are representative of virtually all types of commercially available shaving creams currently sold to consumers throughout the United States and a majority of the industrialized countries of the world.

Preferably, the device 10 is comprised of a generally C-shaped or U-shaped holder member 12 formed on or attached to the cap 14. In the embodiment shown, particularly in FIGS. 1 and 3, the holder member 12 is provided with first and second arm portions 12*a*, 12*b* which define an aperture 18. It will be recognized by those skilled in the art, however, that although depicted as having a generally C- or U-shape, the devices of the present invention may take any of a variety of forms, such as hooks, loops and the like, which provide the necessary structure to support a conventional razor as discussed herein.

Figure 2:
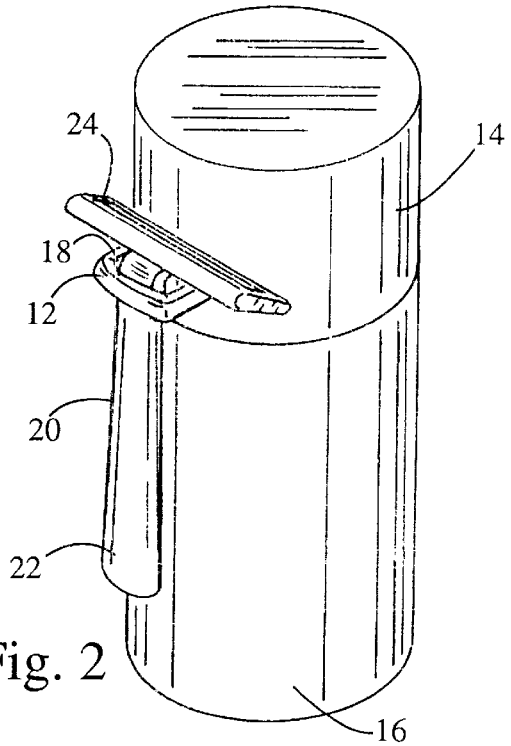
FIG. 2 is a perspective view of the shaving cream can, cap and razor holder apparatus of FIG. 1, the latter being utilized to hold and secure a conventional razor therewith.
Figure 3:
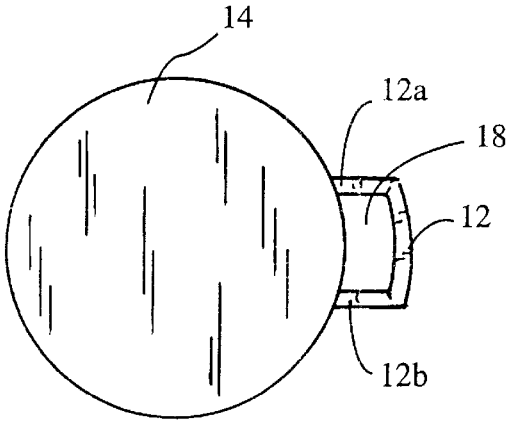
FIG. 3 is a top view of the shaving cream can cap of FIG. 1 with the razor holder apparatus of the present invention formed thereon.
Figure 4:
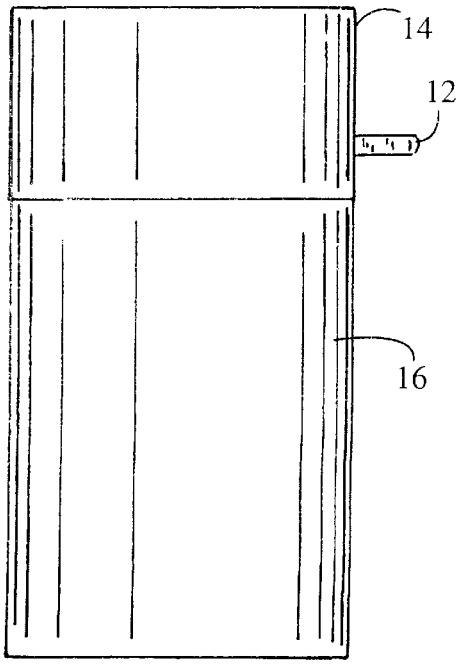
FIG. 4 is a side view of the shaving cream can, cap, and razor holder apparatus of FIG. 1.

As illustrated in FIG. 2, the aperture 18 defined by the holder member 12 provides an axial pathway through which the handle portion 22 of a conventional hand-held razor 20 may extend. As is known, such razors 20 are typically formed to have such elongate handle portion 22, with razor head 24 being disposed at the distal end thereof. The razor head portion 24 houses one or more blade members that are oriented to provide a cutting action when pulled or scraped across the user's skin.

Once the handle portion 22 of such razor 20 is axially extended through the aperture 18 as illustrated in FIG. 2, the razor head portion 24 is caused to rest upon the holder member 12, and more particularly the arms 12*a*, 12*b* thereof. As such, the razor 20 is held and stored in close proximity to the can of shaving cream 16 so that such complementary items can be easily and readily accessed. Of additional advantage is the fact that by forming the holder member 12 upon the shaving cream cap 14, there is thus provided ease of manufacture insofar as such cap members are typically formed of plastic and are amenable to being easily and readily molded such that the holder member 12 can be fused or otherwise integrally formed thereupon. The can portion 16, in contrast, which is typically fabricated from sheet metal and the like, normally does not offer such advantage. It should be understood, however, that the device 10 of the present invention may be formed anywhere upon either the cap or the can so long as the razor may be securably held or positioned therewith. Likewise, it will further be understood that the device 10 may be formed to have any of a variety of shapes and colors as may be necessary for a given application or as may deemed aesthetically pleasing.

To use the device 10 of the present invention, the user need only lift the handle portion 22 of the razor 20 through the aperture 18 defined by the holder member 12 during use and thereafter replace the same by inserting the handle portion of the razor axially through the aperture 18.

In an alternative embodiment not shown, there may be provided two inwardly-biased barb members formed in generally parallel relation to one another which cooperate to frictionally retain the razor, and more particularly the handle portion thereof, when the same is pushed or compressed thereagainst. In this regard, it is contemplated that such holder may act as a clip which enables the user to detachably fasten the razor to the shaving cream cap prior to or following use of the razor.

Figure 6:
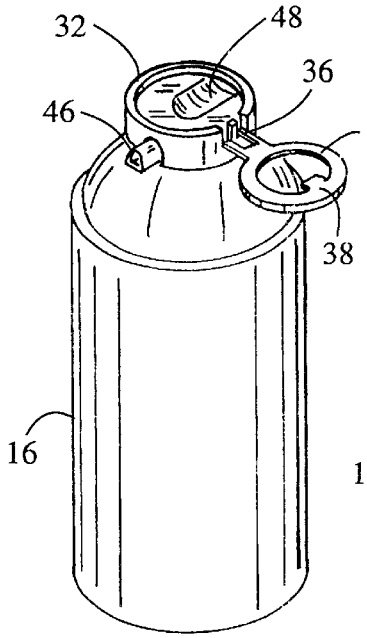
FIG. 6 is a perspective view of the shaving cream can and razor holder apparatus of FIG. 5, the latter assuming a second open or operative configuration.
Figure 7:
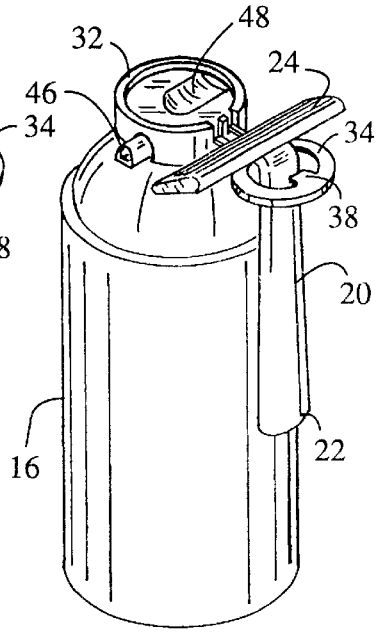
FIG. 7 is a perspective view of the shaving cream can and razor holder apparatus of FIG. 6, the latter being utilized to receive and hold a conventional razor.
Figure 8:
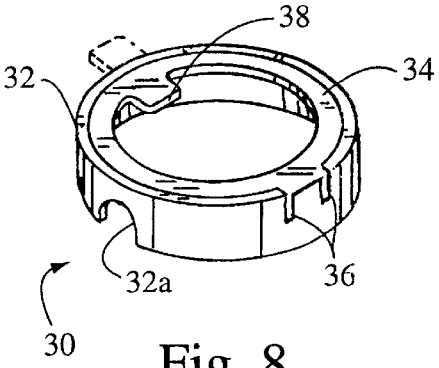
FIG. 8 is a perspective view of the razor holder apparatus of the present invention as constructed according to the second preferred embodiment wherein the apparatus is shown assuming the first closed or locked configuration.
Figure 9:
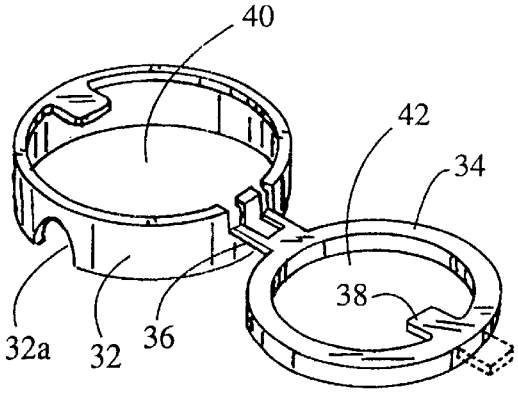
FIG. 9 is a perspective view of the razor holder apparatus depicted in FIG. 8 wherein said apparatus is shown assuming the second open or operative configuration.

Referring now to FIGS. 5–9, and initially to FIG. 8, there is shown a razor holder apparatus 30 constructed in accordance to a second preferred embodiment of the present invention. As illustrated, the device 30 comprises the combination of a first outer annular member 32 within which is axially and concentrically disposed a second inner annular member 34. The second annular member 34 is attached via a hinge connection 36 which thus enables the second annular member 34 to selectively transition between a first locked or closed, non-operative configuration as depicted in FIG. 8, and a second open or operative configuration as depicted in FIG. 9.

Figure 5:
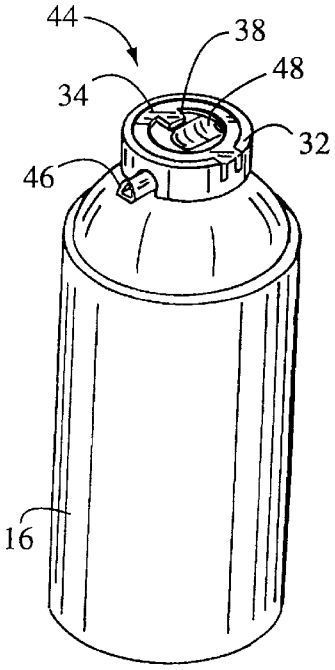
FIG. 5 is a perspective view of a conventional can of shaving cream having a razor holding apparatus formed upon the dispenser thereof, the latter being constructed in accordance to a second preferred embodiment of the present invention with said razor holding apparatus assuming a first closed or locked configuration.

The device 30 is sized and adapted to be detachably fastened to the dispenser mechanism 44 of a conventional can of shaving cream 16 as depicted in FIGS. 5–7. As is well-known in the art, such dispenser mechanisms 44 generally comprise an annular base portion with a dispenser port 46 formed thereupon. Disposed upon the top of such base is a button or other actuatable device 48 that, when manually depressed, causes shaving cream to become dispensed through the dispenser port 46. As is well-known in the art, because of the pressurized contents of the shaving cream can, actuation of the button 48 readily produces shaving cream to be emitted therefrom.

In the embodiment shown, the device 30 is preferably formed to be detachably mountable upon the dispenser mechanism 44 such that the first annular member 32 remains axially anchored thereabout while the second annular member is allowed to selectively transition between the first closed, non-operative configuration as shown in FIG. 5, to the second open, operative configuration as depicted in FIGS. 6 and 7. To accommodate the dispenser port 46, as well as provide means for properly orienting the device 10 upon the dispenser mechanism 44 of the can of shaving cream 16, a first annular member 32 may be provided with an arcuate notch 32*a*, more clearly seen in FIGS. 8 and 9, to accommodate such dispenser port 46. In a further refinement of the invention, the device 30 may be provided with a latch member 100 and 100*a* formed upon either of the first annular member 32, second annular member 34, or both, to enable such members 32, 34 to remain detachably fastened to one another while in the first closed, non-operative configuration.

When the device is caused to assume the open, operative configuration, the second annular member 34 thus defines an aperture 42, depicted in FIG. 9, spaced sufficiently away from the can of shaving cream 16 such that there may be axially inserted therethrough the handle portion 22 of a conventional razor 20, similar to the embodiment depicted in FIGS. 1–4. In this respect, the handle portion 22 of the razor 20 is allowed to depend through the aperture 42 defined by the second annular member 34 such that the razor head 24 is allowed to rest thereupon. In use, the user need only withdraw the razor 20, and in particular the handle portion 22 thereof, through the aperture 42 defined by the second annular member 34 for use, and thereafter replace the same therethrough as shown in FIG. 7. The second annular member 34 may optionally be provided with a detent member 38 for firmly positioning the razor 20 within aperture 42 when the same is not use.

Advantageously, by virtue of the capability of the device 30 to assume the non-operative configuration, the device 30 avoids interfering with any type of cap or cover that may be placed thereover and upon the can 16. Moreover, due to the concentric nature of the apertures 40, 42 defined by the first and second annular members 32, 34, as depicted in FIG. 9, it will be recognized that the device 30 will at no time interfere with the ability of the user to actuate the dispenser button 48 of the dispenser mechanism 44 and, as a consequence, will provide the utility of holding a razor 20 in close proximity to the can 16 without interfering with the function of the latter. Additionally, because of its ability to detachably fasten to the dispenser apparatus, the device 20, as constructed in accordance to the second preferred embodiment may thus be utilized repeatedly for long-term use.

With respect to construction of the apparatus 30, it will be recognized by those skilled in the art that such holder apparatus may be formed from any of a variety of materials well-known in the art, and in particular plastics and the like. It will further be recognized that the same will preferably be formed to be water impervious due to the likelihood the same will come in contact with water. Moreover, it will be recognized by those skilled in the art that although the holder apparatus 30 shown is depicted as being mountable upon the dispenser apparatus of the shaving cream can, such apparatus could be sized and adapted to fit upon any portion of the can 16 provided that the second annular member 34 thereof may be allowed to selectively transition between the aforementioned operative and non-operative configurations.

Although the invention has been described herein with specific reference to a presently preferred embodiment thereof, it will be appreciated by those skilled in the art that various modifications, deletions, and alterations may be made to such preferred embodiment without departing from the spirit and scope of the invention. Accordingly, it is intended that all reasonably foreseeable additions, modifications, deletions and alterations be included within the scope of the invention as defined in the following claims.

What is claimed is:

1. An apparatus for receiving and securing a razor having a handle portion and razor head portion to a dispenser mechanism of a can of shaving cream comprising:

a) a first annular member detachably fastenable to said dispenser of said shaving cream can; and b) a second annular member hingingly engaged to said first annular member, said second annular member being selectively transitionable between:

i) a first non-operative configuration whereby said second annular member is axially and concentrically disposed about said first annular member; and ii) a second operative configuration wherein said second annular member extends sufficiently outward from said first annular member such that when said first annular member is mounted upon said dispenser apparatus of said shaving cream can, said second annular member defines an aperture for axially accommodating the handle portion of a razor extensible therethrough, said second annular member further defining a support for receiving the razor head portion of said razor and selectively suspending said razor thereby.

2. The apparatus of claim 1 further comprising a clasp member for securing said first and second annular members to one another when said second annular member assumes said first non-operative configuration.

3. The apparatus of claim 1 wherein said second annular member is sized and adapted to radially nest within said first annular member when said second annular member assumes said first non-operative configuration.

4. The apparatus of claim 3 wherein when said second annular member is nested within said first annular member, a concentrically disposed aperture is formed through said first and second annular members such that said dispenser mechanism of said shaving cream can may be manually actuated therethrough.

5. The apparatus of claim 1 wherein said apparatus is formed of water-impervious material.

6. The apparatus of claim 1 wherein said apparatus is formed from plastic.

7. The apparatus of claim 1 wherein said second annular member is provided with a detent formed thereon for rigidly securing the handle portion of said razor therewithin when said handle portion is disposed within the aperture formed thereby.

* * * * *